US007219724B2

(12) United States Patent
Theriot, Sr.

(10) Patent No.: US 7,219,724 B2
(45) Date of Patent: May 22, 2007

(54) DOWNHOLE MAGNETIC RETRIEVAL TOOL

(75) Inventor: Clayton Theriot, Sr., Houma, LA (US)

(73) Assignee: Bilco Tools, Inc., Houma, LA (US)

( * ) Notice: Subject to any disclaimer, the term of this patent is extended or adjusted under 35 U.S.C. 154(b) by 229 days.

(21) Appl. No.: 10/892,644

(22) Filed: Jul. 15, 2004

(65) Prior Publication Data

US 2006/0011346 A1 Jan. 19, 2006

(51) Int. Cl.
*E21B 37/00* (2006.01)

(52) U.S. Cl. ..... 166/66.5; 166/99

(58) Field of Classification Search ..... 166/66.5, 166/99

See application file for complete search history.

(56) References Cited

U.S. PATENT DOCUMENTS

| | | | | |
|---|---|---|---|---|
| 2,709,104 | A | 5/1955 | Gibbs | |
| 2,729,494 | A | 1/1956 | Trowbridge | |
| 2,918,323 | A | 12/1959 | Coffee | |
| 3,089,724 | A | 5/1963 | Crooks | |
| 3,637,033 | A * | 1/1972 | Mayall | 175/320 |
| 3,905,631 | A | 9/1975 | Ricks et al. | |
| 4,226,285 | A | 10/1980 | Moseley, Jr. | |
| 5,178,757 | A | 1/1993 | Corney | |
| 5,453,188 | A | 9/1995 | Florescu et al. | |
| 5,454,943 | A * | 10/1995 | Ashton et al. | 210/222 |
| 5,944,100 | A | 8/1999 | Hipp | |
| 6,216,787 | B1 | 4/2001 | Ruttley | |
| 6,269,877 | B1 | 8/2001 | Zeer et al. | |
| 6,308,781 | B2 | 10/2001 | Ruttley | |
| 6,354,386 | B1 | 3/2002 | Ruttley | |
| 6,357,539 | B1 | 3/2002 | Ruttley | |
| 6,439,303 | B1 | 8/2002 | Sorhus et al. | |
| 6,491,117 | B2 | 12/2002 | Ruttley | |
| 6,629,562 | B1 | 10/2003 | Fidan | |
| 6,655,462 | B1 | 12/2003 | Carmichael et al. | |
| 2001/0013413 | A1 | 8/2001 | Ruttley | |
| 2003/0159834 | A1 * | 8/2003 | Kirk et al. | 166/378 |
| 2005/0184611 | A1 * | 8/2005 | Rinholm et al. | 310/156.21 |

OTHER PUBLICATIONS

SPS AFOS—Wellbore Completion Services, Magno Back Literature, p. 8.
Rattler Tools, Mag-Trap Liertature.

* cited by examiner

*Primary Examiner*—William Neuder
*Assistant Examiner*—Nicole Coy
(74) *Attorney, Agent, or Firm*—Browning Bushman P.C.

(57) ABSTRACT

A tool 10 for suspending in a well retrieves various metal debris from the well, and includes an elongate tool body 12 within a plurality of circumferentially shaped slots 14. Each slot having a radially outward portion with a circumferential width less than a circumferential width of a radially inward portion. The plurality of magnets 16 are provided in each slot, and one or more stop rings 18 retain the plurality of magnets in the slots while allowing for removal of the magnets from the slots. Each of the plurality of magnets 16 may be substantially enclosed within a non-ferrous carrier 26 having an outer configuration for fitting within a respective of one of the plurality of slots. According to the method of invention, the magnets are postioned within the slots and are retained within the slots by the one or more stop rings, and the elongate tool body and the plurality of the magnets are suspended in a well.

20 Claims, 7 Drawing Sheets

DOWNHOLE MAGNETIC RETRIEVAL TOOL

FIELD OF THE INVENTION

The present invention relates to wellbore tools and methods for retrieving metal debris, such as cuttings and other metal objects, that may be formed by milling downhole objects, by unintentionally dropping an object in a wellbore, or by intentionally releasing a portion of a tool to fall in the well and subsequently be removed. More specifically, the tool of the present invention utilizes magnetic forces to attract ferrous metal debris, so that the tool effectively captures the debris and may then be retrieved to the surface from the wellbore.

BACKGROUND OF THE INVENTION

When drilling an oil or gas well, or when refurbishing an existing well, normal operations may result in various types of metal debris in a well. Downhole milling produces cuttings which often are not completely removed by circulation. Other metallic objects may drop into and collect near the bottom of the well, or on intermediate plugs placed within the well.

Methods have been used to circulate fluids up the annulus at a rapid rate and thereby carry debris upward, with expectations that the debris will then settle into the basket for retrieval when circulation is reduced. Some basket tools utilize a venturi action to drawn debris into the tool.

Other tools utilize magnets mounted within a housing for being lowered into the well. Some tools practically may be limited to retrieving cutting since magnetization is only at the bottom of the tool. Other tools utilize a plurality of magnets aligned in cavities near the outer surface of the tool. Each magnet may be recessed in the tool body. Exposed magnets are subject to physical damage during the process of cleaning debris from the well. Conventional metal debris retrieving tools are relatively expensive, and it is difficult or impossible to effectively clean and change out the magnets of most tools in the field.

U.S. Pat. No. 6,655,462 discloses magnets within an interior of a rotatable protective sleeve. U.S. Pat. Nos. 6,216,787, 6,308,781, and 6,491,117 disclose magnetic tools and magnet protectors for deflecting a striking force on the magnets. U.S. Pat. No. 6,439,303 discloses the retainer caps for mounting each of a plurality of magnets within a recess in the tool body. Publication 2001/4013413 discloses in one embodiment a magnet which covers substantially the entire surface of the tool body. Other patents of interest include U.S. Pat. Nos. 2,089,724, 2,709,104, 2,729,494 and 2,918,323, 3,905,631, 4,226,285, 5,178,757, 5,453,188, 5,944,100, 6,269,877, and 6,629,562.

The disadvantages of the prior art are overcome by the present invention, and an improved magnetic retrieval tool and method are hereinafter disclosed for retrieving debris from a well.

SUMMARY OF THE INVENTION

In one embodiment, a tool for suspending in a well to retrieve ferrous metal debris from the well includes an elongate tool body having a plurality of circumferentially arranged slots. Each slot has a radially outward portion with a circumferential width less than a circumferential width of a radially inward portion. A plurality of magnets may be positioned in each slot, and one or more stop rings, such as centralizers, used for axially retaining the plurality of magnets in the slots. Each of the stop rings is removable from the tool body, thereby allowing removal of the plurality of magnets from the plurality of the slots in a field operation.

In a preferred embodiment, the tool body includes a central bore for pumping fluid through the tool body, and the upper end of the tool body is configured for attaching to a tubular extending into the surface. The outer surface of each centralizer has an effective diameter greater than the outer surface of the plurality of magnets.

In one embodiment, each of the plurality of slots has substantially a dovetail configuration, while in another embodiment, each of the plurality of slots has a substantially T-shaped configuration. Each of the plurality of magnets in substantially enclosed within a magnet carrier, with the non-ferrous carrier having an outer configuration for slidably fitting within a respective one of the plurality of slots. In one embodiment, each magnet has a substantially cylindrical configuration, and the carrier is formed from one of stainless steel, aluminum and a high wear plastic material.

According to the method, a tool body is provided with a plurality of slots as discussed above, and magnets are positioned within each slot and are held in place by one or more stop rings removable from the tool body. The tool with the magnets may then be positioned in the well for collecting and subsequently retrieving metal debris.

A significant feature of the invention is that the magnets are reliably held within the tool body, yet may be easily removed from the tool body in a field operation for repair or cleaning.

Yet another feature of the invention is that the tool protects each magnet within a magnet carrier which slides within a respective slot.

A significant advantage of the tool and method is that the tool may be used and easily cleaned and repaired in a field operation.

These and further features and advantages of the present invention will become apparent from the following detailed description, wherein reference is made to the figures of the accompanying drawings.

DETAILED DESCRIPTION OF PREFERRED EMBODIMENTS

Figure 1:
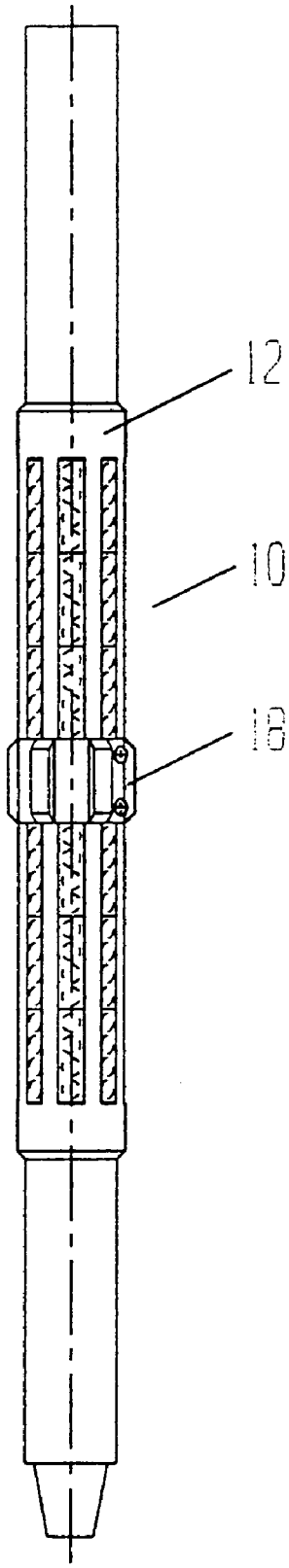
FIG. 1 illustrates one embodiment of a magnetic tool according to the present invention.

FIG. 1 depicts a magnetic tool according to one embodiment of the invention. The tool 10 includes an elongate tool body 12 which has circumferentially arranged slots 14 (see FIG. 4) each for receiving a plurality of magnets 16. With the embodiment pictured in FIG. 1, a centralizer 18 is provided near the central portion of the tool 10, and is spaced below a plurality of upper slots and above a plurality of lower slots.

Figure 2:
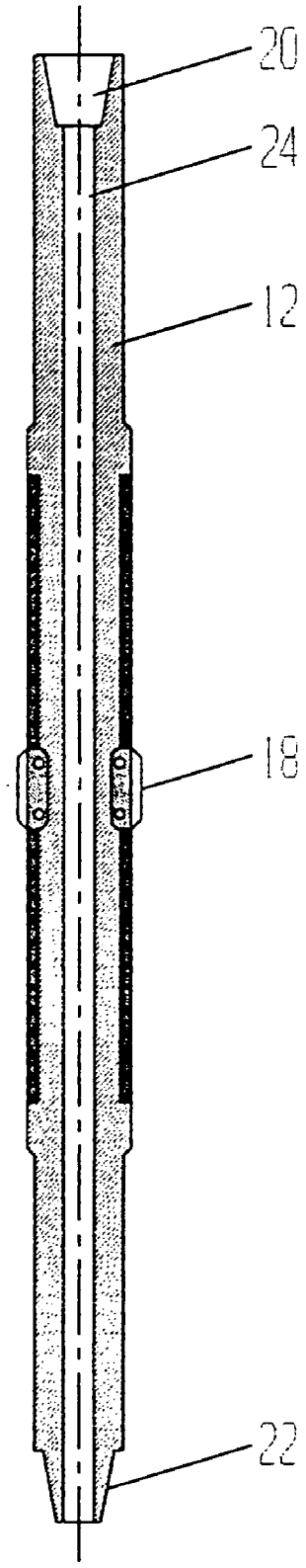
FIG. 2 is a cross-sectional view of the magnetic tool shown in FIG. 1.

As shown more clearly in FIG. 2, a tool body 12 includes an upper box end 20 for threading the tool to a conventional running string, and a lower pin end 22 for attaching a continuation of the running string or another tool to the lower end of the tool body 12. A central bore 24 is provided through the tool body, and passes fluid from the string through the tool body for washing the well, which substantially contributes to an upward flow of debris and the collection of debris on the magnets.

Figure 3:
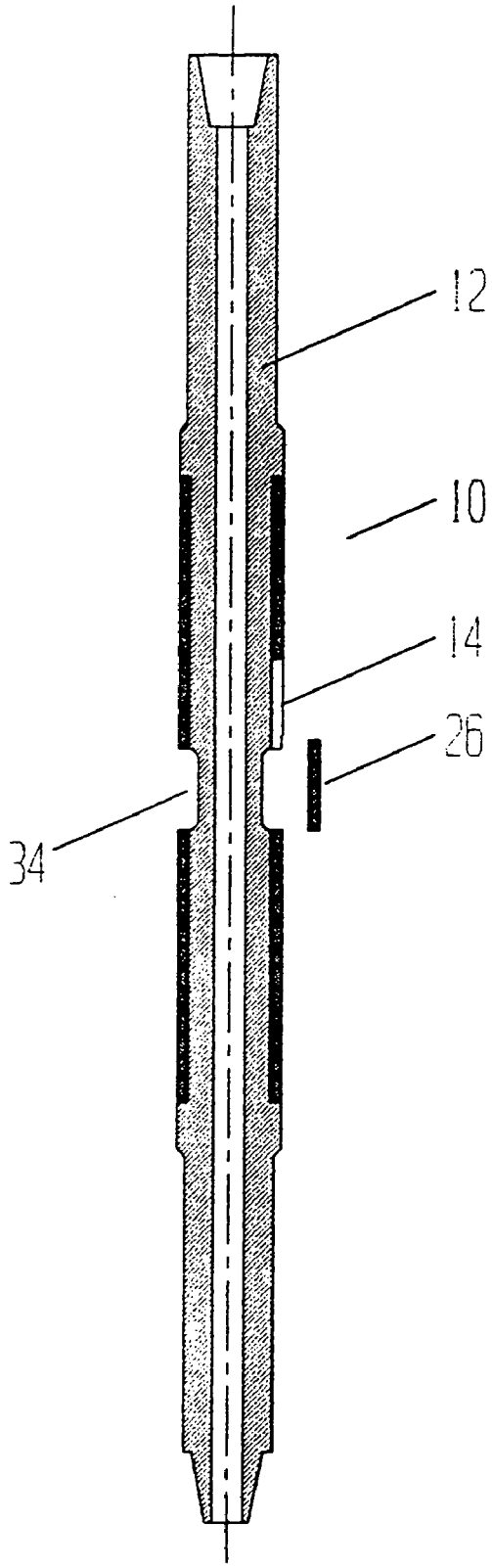
FIG. 3 illustrates a tool as shown in FIG. 2 with the centralizer removed and one of the magnet strips removed.
Figure 4:
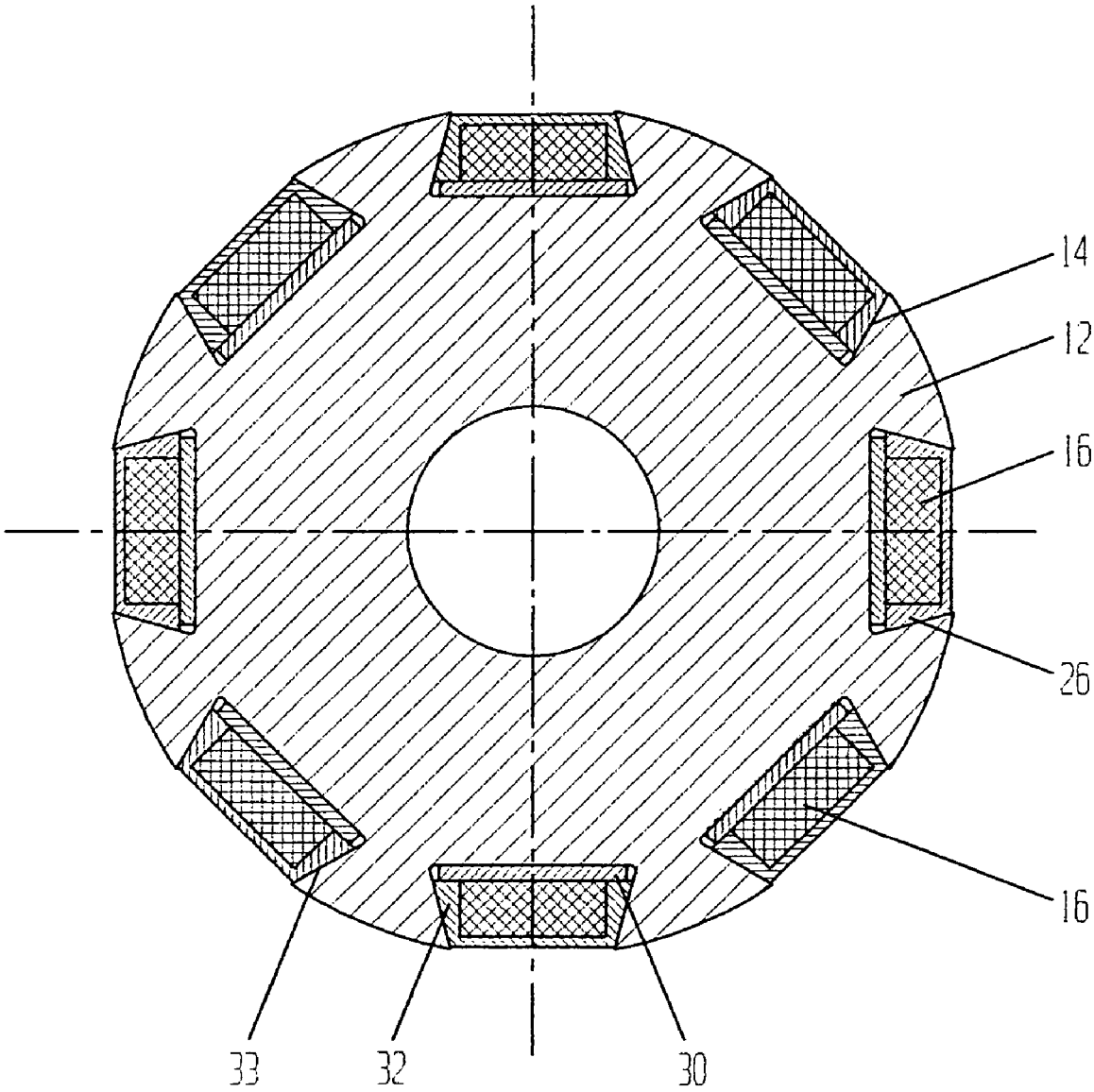
FIG. 4 is a cross-sectional view of the tool as shown in FIG. 1.

The magnets may be provided in elongate carrier strips, and FIG. 3 illustrates the centralizer 18 removed from the tool body 12 so that each carrier strip may be lowered or raised through a slot and easily removed from the tool body. One of the carrier strips 26 is thus shown removed from a respective slot in FIG. 3. As shown in FIG. 4, each magnet 16 may be substantially enclosed within a non-ferrous carrier strip 26, which may consist of a non-ferrous radially interior spaced plate 30 and a side and cover plate 32 with a substantially U-shaped cross-sectional configuration. The entirety of the magnet 16 is thus protected from contact with both the tool body 12 and from debris and other objects exterior of the tool body. FIG. 4 illustrates that the slots 14 may each have a substantially dovetail configuration, with the radially inner portion having a circumferential width wider than a radially outer portion, thereby capturing the carrier and the magnets within the carrier within the tool body. Each carrier strip 26 may thus be slid within a respective slot, and may be retained within the slot by the centralizer.

Returning again to FIG. 3, each dovetail slot 14 thus is open to a recess portion 34 within the tool body configured to receive the centralizer 18. If desired, the end of each slot adjacent to the recessed portion 34 may be removed, or may have a uniform circumferential width, so that a carrier 26 axially longer than the axial length of the recessed portion 34 may still be slid within a respective slot.

Figure 5:
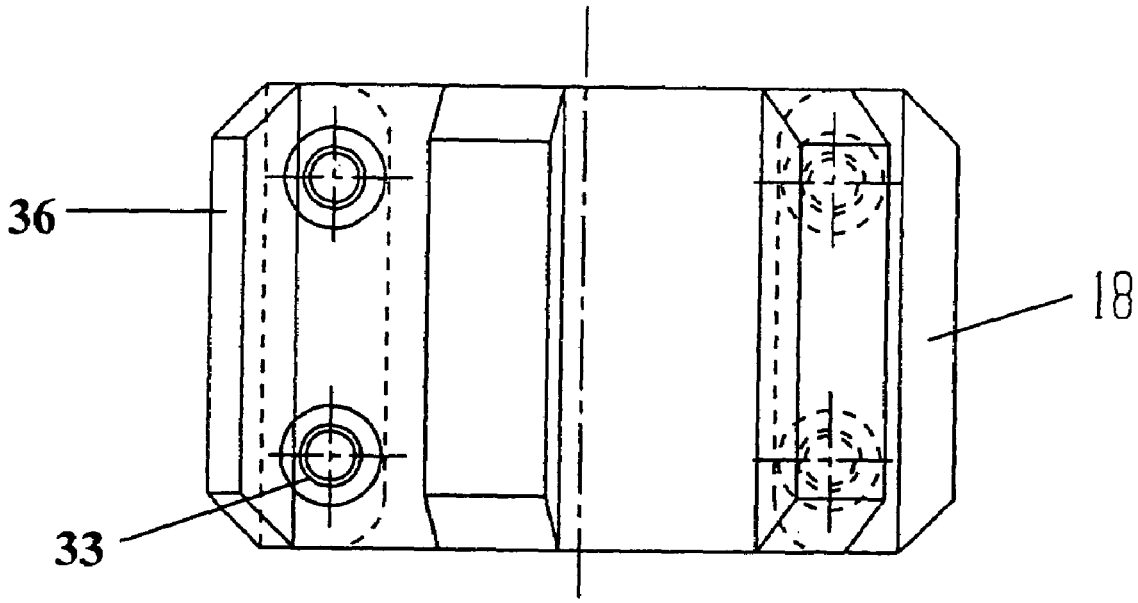
FIG. 5 is a top view of the centralizer generally shown in FIG. 1.
Figure 6:
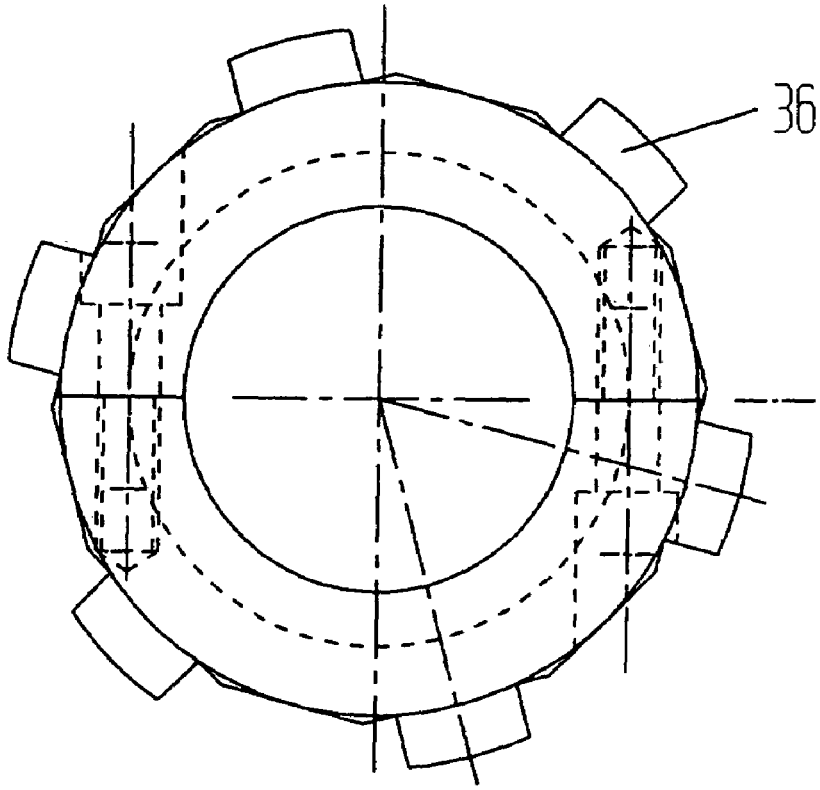
FIG. 6 is a side view of the centralizer shown in FIG. 5.

FIG. 5 illustrates the centralizer 18, which as shown in FIG. 6 has a plurality of ribs 36 with an effective diameter greater than the diameter of the magnets or the carrier, so that ribs 36 prevent the carrier from engaging a sidewall of the well and retain collected debris on the outer surface of the tool. The space between the ribs 36 provides fluid flow in the annulus surrounding the tool body. Conventional bolts or other securing members may be used to connect the two halves of the centralizers together when on the tool body. The centralizer 18 may be configured for being rotatably fixed to the tool body, or may rotate relative to the tool body. The centralizer 18 may be easily removed from the tool body by removing bolts 33.

Figure 7:
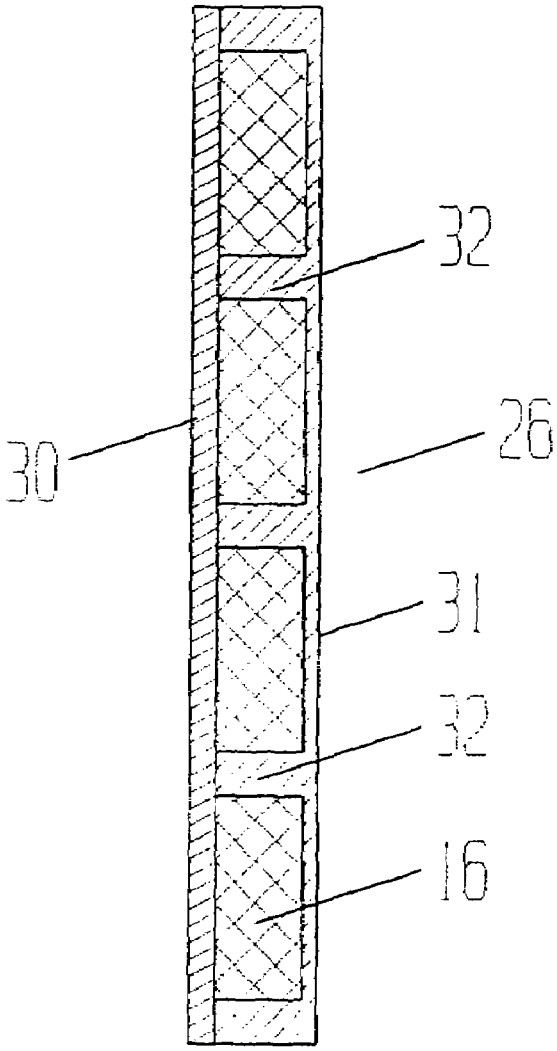
FIG. 7 is a front view of a plurality of magnets in a magnet carrier.
Figure 8:
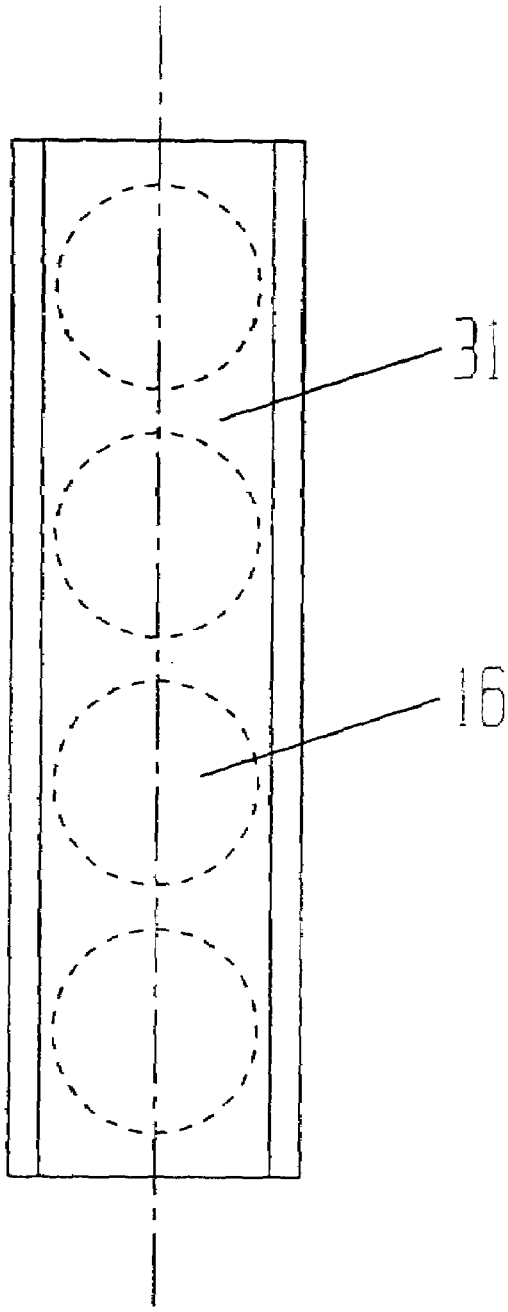
FIG. 8 is a side view of the magnets and carrier shown in FIG. 7.

FIG. 7 depicts in greater detail one of the magnet carrier strips 26 with the non-ferrous base plate 30 and the side and top protector 32. The protector 32 may include radially outer cover 31 and rib portions 32 spaced between cover 31 and plate 30. As shown in FIG. 8, each of the magnets 16 may have a substantially circular configuration, or more particularly a cylindrical configuration, as shown in FIG. 7. Cylindrical magnets of the type shown in FIGS. 7 and 8 have a relatively low cost, are highly reliable, and are preferred in many applications compared to elongate magnets. In other embodiments, however, a single elongate magnet or more than one elongate magnet may be provided within the substantially enclosed non-ferrous carrier. A non-ferrous carrier may be formed from one of stainless steel, aluminum or a high-wear plastic material.

A non-ferrous magnet carrier 26 formed from the base plate 30 and the side and top protector 32 at least substantially encloses each of the respective magnets 16. This enclosure is highly desired to protect the magnets from foreign objects external of the tool, since the magnets otherwise may strike objects in the well and fracture or otherwise become damaged. Carrier 32 separates the tool body 12 and the magnets by providing a non-ferrous magnet carrier between the sides of each slot and each magnet. Most importantly, the carrier formed from the base plate 30 and the protector 32 may be easily slid from the respective slot in the tool body at the surface, and disassembled, cleaned, and if necessary repaired at the well site. The base plate 30 may be removed from protector 32, then the magnets 16 each removed from its respective pocket within protector 32. As shown in FIG. 4, the carrier 26 thus has an outer configuration for slidably fitting the carrier and the magnets positioned therein within the respective one of the plurality of slots.

Figure 9:
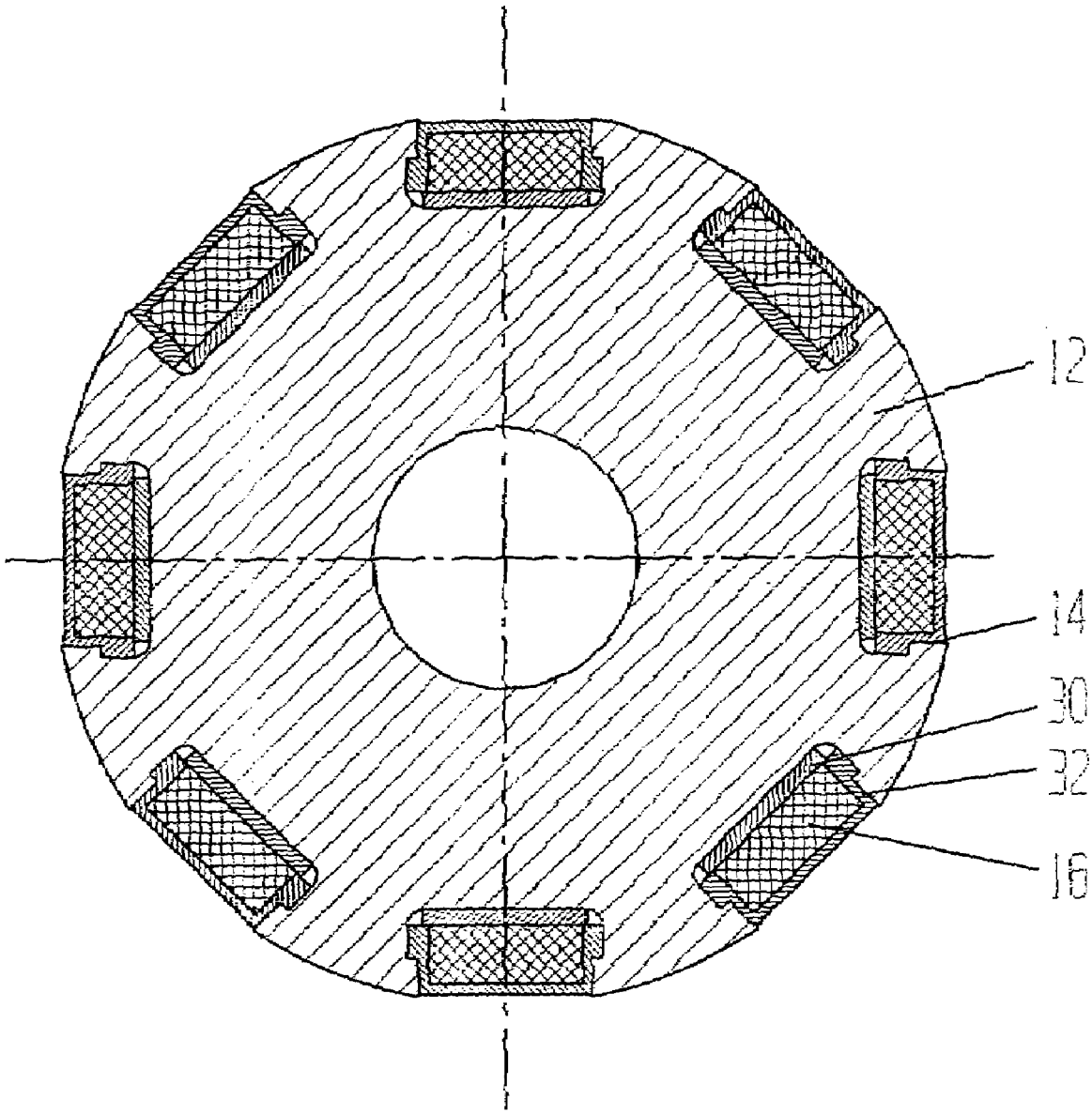
FIG. 9 is a partial cross-section view of another slot in the tool body.

FIG. 9 illustrates a partial cross sectional view of another slot which is substantially T-shaped configuration in a tool body. Other configurations for securing the magnetic strip in the slot may be used, with the slot having a radially inner portion which is circumferentially wider than a radially outer portion.

A tool 10 retrieves ferrous metal debris from a well, and includes an elongate tool body 12 having a plurality of circumferentially arranged slots 14 each for receiving a plurality of magnets. One or more stop rings 18 retain the plurality of the magnets within the slot. Each stop ring is removable from the tool body, thereby allowing the removal of the plurality of the magnets from the plurality of slots. According to the method, the tool is provided with the slots and the magnets, and is suspended in a well to retrieve various metal debris.

The magnetic tool as disclosed above includes a single stop ring 18, which may easily be removed from the tool body. Depending on the desired axial length of the magnets throughout the length of the tool, and in part depending upon the maximum allowed travel length of the farthest magnet to its exit point on the tool, more than one stop ring may be provided. A plurality of carrier 26 are preferably provided in each slot. Each axially spaced stop ring may be removable from the tool body so that magnets may slide out of their respective slots and into the cavity formed when the stop ring is removed. Depending on the number and configuration of the stop rings provided along the tool body, it may be desirable to position stabilizers or centralizers above, below, and possibly between the magnets to provide protection to the metal object attracted to the magnets.

In a preferred embodiment, the stop ring may comprise a centralizer with a plurality of ribs having an outer surface spaced outward from the magnets, thereby providing protection to objects attracted to the outer surface of the tool. The centralizer may be rotatably fixed to the tool body or may be rotable on the tool body. If desired, bearings may be provided to allow the centralizer to more easily rotate on the tool body.

The term "stop rings" as used herein is intended to mean a substantially ring-shaped member which fits on the tool body and axially secures the carrier strips and the magnets therein on the tool body. The stop ring may be completely circular, or in other configurations may be substantially C-shaped to satisfy the purpose as disclosed herein.

In the embodiment depicted, the upper end of the tool body 12 is configured for receiving a tubular for suspending the tool body in the well, and for passing fluid through a central bore in the tool body. In other embodiments, the tool may be configured for connection to a wireline, or to another type of tubular for suspending the tool in the well.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alternations and modifications, including but not limited to those design alternatives specifically discussed herein, may be made in the practice of the invention without departing from its scope.

The invention claimed is:

1. A tool for suspending in a well to retrieve ferrous metal debris from the well, the tool comprising:

an elongate tool body having an upper end configured for suspending the tool body in the well;

the tool body having a plurality of circumferentially arranged slots, each slot having a radially outward portion with a circumferential width less than a circumferential width of a radially inward portion;

a plurality of magnet carriers each having an outer configuration for slidedly fitting within a respective one of the plurality of slots;

a plurality of magnets supported on each magnet carrier; and one or more stop rings for axially retaining the plurality of magnets in the slots, each of the one or more stop rings being removable from the tool body and thereby allowing removal of the plurality of magnets from the plurality of slots.

2. A tool as defined in claim 1, wherein the tool body includes a central bore for pumping fluid through the tool body, the upper end of the tool body being configured for attaching to a tubular extending to the surface.

3. A tool as defined in claim 1, wherein each of the plurality of slots has a substantially dovetail configuration.

4. A tool as defined in claim 1, wherein each of the plurality of slots has a substantially T-shaped configuration.

5. A tool as defined in claim 1, wherein each of the one or more stop rings is a centralizer having an outer surface with an effective diameter greater than an outer surface of each of the plurality of magnets and the tool body.

6. A tool as defined in claim 5, wherein each of the one or more centralizers is rotationally secured to the tool body.

7. A tool as defined in claim 5, wherein each of the one or more centralizer rotates relative to the tool body.

8. A tool as defined in claim 1, wherein each of the plurality of magnets is at least substantially enclosed within the carrier, the carrier being a non-ferrous material carrier.

9. A tool as defined in claim 8, wherein each of the plurality of magnets has a substantially cylindrical configuration with a magnet central axis perpendicular to an axis of the elongate tool body.

10. A tool defined in claim 8, wherein the carrier is formed inn one of stainless steel, aluminum, and a high-wear plastic material.

11. A tool for suspending in a well to retrieve ferrous metal debris from the well, the tool comprising:

an elongate tool body tool having a central bore for pumping fluid through the tool body, the upper end of the tool body being configured for attaching to a tubular extending to the surface for suspending the tool body in a well;

the tool body having a plurality of circumferentially arranged slots;

a plurally of magnets In each slot each of the plurally of magnets is at least substantially enclosed within a non-ferrous carrier, the carrier having an outer configuration for slidably fitting within a respective one of the plurally of slots; and one or more stop rings for axially retaining the plurality of magnets in the slot, each of the one or more stop rings being removable from the tool body and thereby allowing removal of the plurally of magnets from the plurally of slots.

12. A tool as defined in claim 11, wherein each of the plurally of slots has one of a substantially dovetail configuration and a substantially T-shaped configuration.

13. A tool as defined in claim 11, wherein a plurality of upper slots are provided above a respective stop ring, and a plurality of lower slots are provided below the respective stop ring.

14. A tool as defined in claim 11, wherein each magnet has a substantially cylindrical configuration with a magnet central axis perpendicular to an axis of the elongate tool body.

15. A tool as defined in claim 11, wherein each of the one or more stop rings in a centralizer having an outer surface with an effective diameter greater than an outer surface of each of the plurality of magnets and the tool body.

16. A method of retrieving ferrous metal debris from a well, the method comprising:

providing a plurality of circumferentially arranged slots on a tool body, each slot having a radially outward portion with a circumferential width less than a circumferential width of a radially inward portion;

supporting a magnet carrier in each of the plurality of slots, the magnet carrier having an outer configuration for fitting within a respective one of the plurality of slots;

positioning a plurality of magnets on each magnet carrier;

retaining the plurality of carriers in the slots with one or more stop rings, each of the one or more stop rings being removable from the tool body and thereby allowing removal of the plurality of carriers from the plurality of slots; and suspending the elongate tool body and the plurality of magnets in the well.

17. A method as defined in claim 16, further comprising:

the tool body including a central bore, and attaching the upper end of the tool body to a tubular extending to the surface; and pumping fluid through the tool body.

18. A method as defined in claim 16, wherein each of the plurality of slots has one of a substantially dovetail configuration and a substantially T-shaped configuration.

19. A method as defined in claim 16, further comprising:

at least substantially enclosing each of the plurality of magnets within the magnet carrier.

20. A method as defined in claim 16, wherein each of the one or more stop rings is a centralizer having an outer surface with an effective diameter greater than an outer surface of each of the plurality of magnets and the tool body.

* * * * *